United States Patent [19]

Guercio et al.

[11] Patent Number: 4,614,846

[45] Date of Patent: Sep. 30, 1986

[54] INTERLOCKED PUSH BUTTON SWITCH ASSEMBLY

[75] Inventors: James Guercio, Glendale; Ronald A. Meyer, San Dimas; Shiro Sakamoto, Claremont, all of Calif.

[73] Assignee: Beckman Industrial Corporation, Brea, Calif.

[21] Appl. No.: 730,640

[22] Filed: May 6, 1985

[51] Int. Cl.[4] ..... H01H 9/26

[52] U.S. Cl. ..... 200/5 E; 74/483 PB; 200/50 C

[58] Field of Search ..... 74/483 R, 483 PB; 200/5 A, 6 R, 5 E, 5 EA, 5 EB, 50 C, 159 R, 254

[56] References Cited

U.S. PATENT DOCUMENTS

| | | | |
|---|---|---|---|
| 1,870,304 | 8/1932 | Wentzel | 200/5 E X |
| 2,914,629 | 11/1959 | D'Aprile | 200/5 EB |
| 3,205,318 | 9/1965 | Bilek | 200/5 E |
| 3,446,090 | 5/1969 | Alexander | 74/483 R |
| 3,746,802 | 7/1973 | Sandi et al. | 200/5 E |
| 3,894,203 | 7/1975 | Diehr | 200/6 R |
| 4,074,089 | 2/1978 | Mitsugi et al. | 74/483 PB X |

*Primary Examiner*—J. R. Scott

*Attorney, Agent, or Firm*—Philip J. Feig

[57] ABSTRACT

A push button switch assembly comprising a plurality of push button switch actuators includes a flexible, unstretchable electrically non-conductive belt for permitting only one of the push button switch actuators at a time to be in its activated position while the remaining switch actuators are all in their deactivated position. The switch assembly cover includes a molded detent spring for maintaining a switch actuator with a shaft having suitably axially spaced detents in its activated position when one of the detents engages the spring. The switch actuator comprises movable contacts aligned to engage respective stationary contacts disposed in the base of the switch assembly when the switch actuator is in its activated position. The belt is strung over tensioning risers disposed in a predetermined path on the base of the switch assembly at each side of a switch actuator. The switch actuator shaft further includes a groove for confining the belt therein.

11 Claims, 5 Drawing Figures

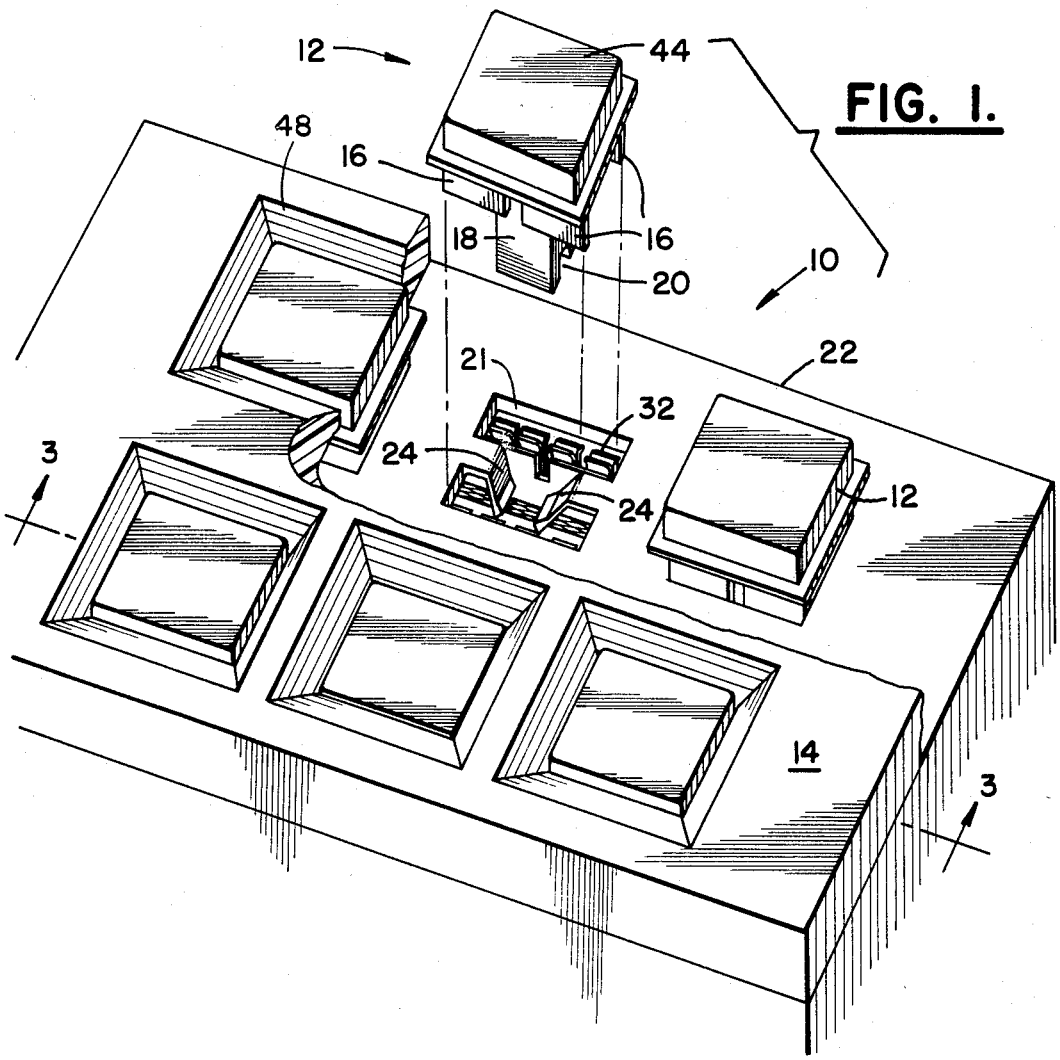
FIG. 1.
FIG. 3.
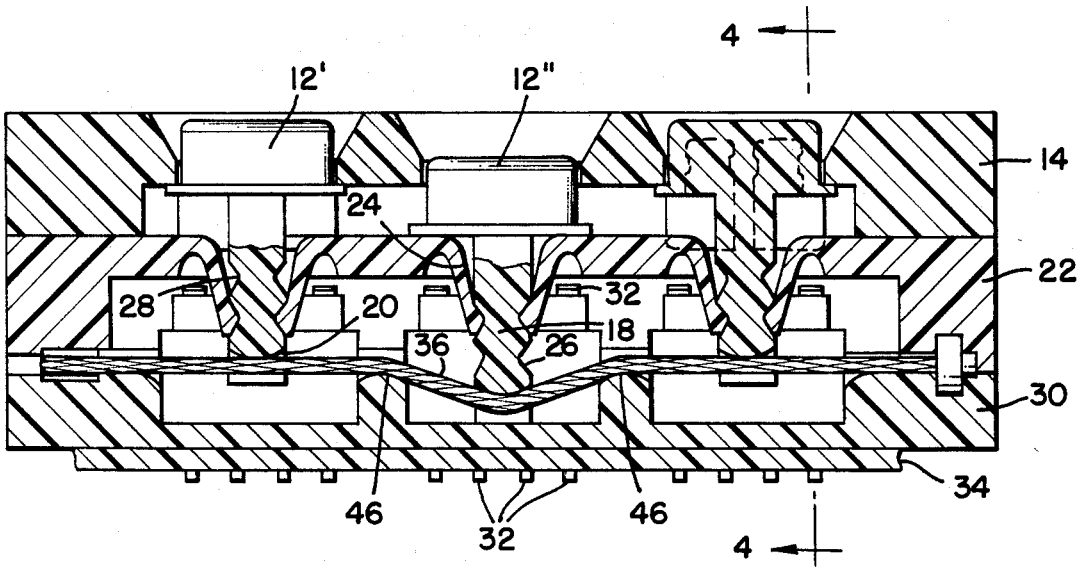

FIG. 2.
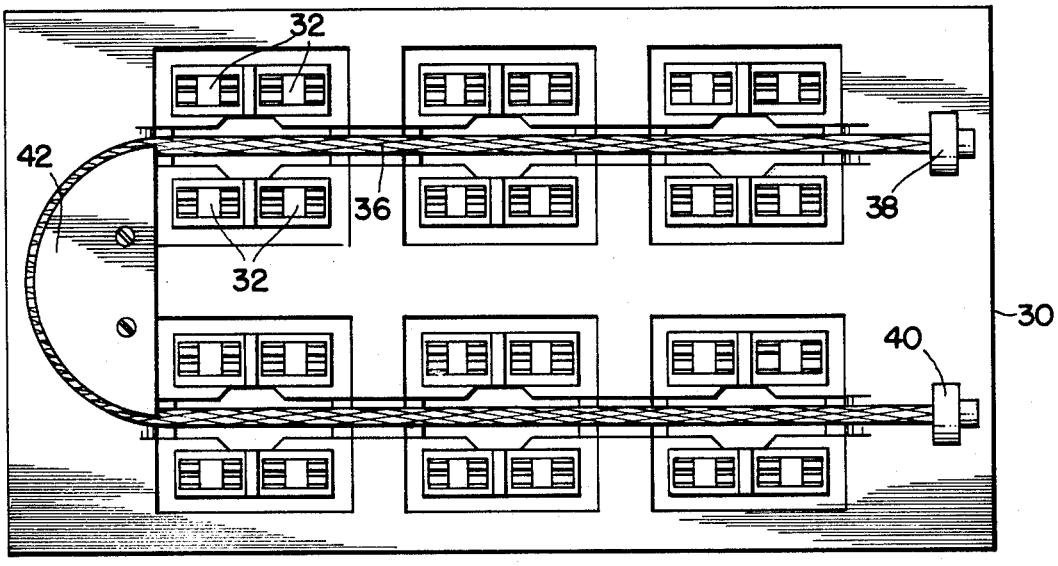
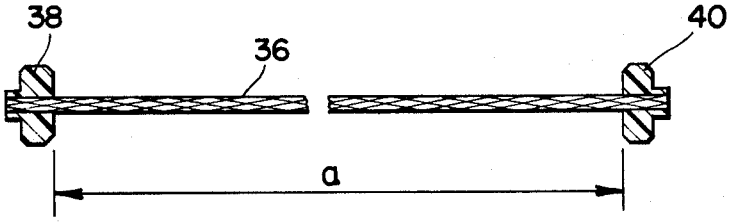
FIG. 5.
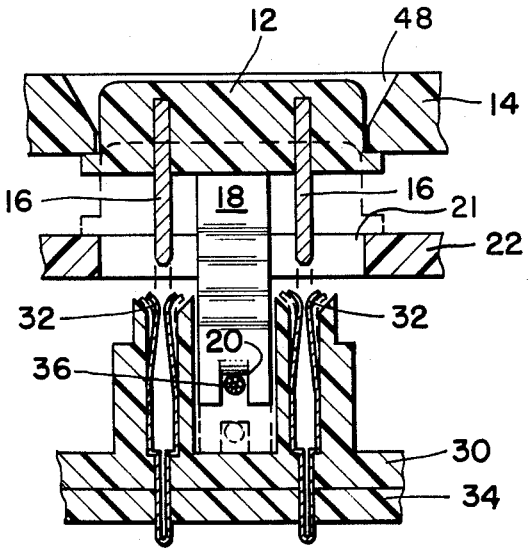
FIG. 4.

INTERLOCKED PUSH BUTTON SWITCH ASSEMBLY

BACKGROUND OF THE INVENTION

The present invention concerns a push button switch assembly and particularly a switch assembly which provides an improved arrangement for permitting only one push button switch actuator to be activated at any time from a plurality of such switch actuators.

Switch assemblies of different types have been previously proposed which enable an operator to select only one switch actuator from a plurality of switch actuators to be activated. Typically, such switch assemblies are provided with a plurality of push button switch actuators that are movable between two positions and interconnected with each other in a manner for causing in response to any one switch actuator being moved to its activated position, a switch actuator previously in that activated position to be returned to its deactivated position.

The difficulty with the prior art arrangements in the relatively complex arrangement of springs, plates, or levers for interconnecting the respective push button switch actuators so that they operate in the desired manner. For example, in U.S. Pat. No. 3,854,018, a cross-curved contact strip interconnects the push button switch actuators. And in U.S. Pat. No. 2,622,160, springs and rigid levers are employed between switch actuators. Also, in U.S. Pat. No. 4,061,072 and U.S. Pat. No. 4,133,989 a plurality of pivotally mounted switch actuators, each including a compression spring and latch mechanism, are coupled together by a string or wire for causing upon depression of a key from its initial position, a previously depressed key to be returned to its initial position.

Due to the complexity of prior art switch assemblies, the quantity of push button switch actuators and the physical configuration of the switch actuators comprising a switch assembly have been limited.

In the present invention, a matrix or assembly of push button switch actuators are interconnected by means of a flexible, unstretchable, electrically non-conductive belt or loop of a specified length which allows only one switch actuator of the assembly to be in an operative or activated position at one time while a switch actuator previously activated is caused to return to its inoperative or deactivated position. The belt is dimensioned so that when any one push button switch actuator is activated, the belt yields in the direction of motion of that switch actuator while the belt tension increases elsewhere along the length of the belt thereby causing a previously activated switch actuator to return to its deactivated position.

In order to maintain a selected push button switch actuator in its activated position, the switch actuator shaft includes a detent for engaging a detent spring molded into the switch assembly cover. The force created by the belt is sufficient for causing the disengagement of the detent of an activated switch actuator from the spring when another push button switch actuator is activated. A relatively simple switch assembly is achieved by molding the detent spring into the switch assembly cover.

A principal object of this invention is, therefore, the provision of an improved push button switch assembly which permits only one switch actuator at a time selected from a plurality of switch actuators to be activated.

A further object of this invention is the provision of a flexible, unstretchable, electrically non-conductive belt of a specified length in combination with a plurality of switch actuators for permitting only one switch actuator at a time to be activated.

Another object of the invention is provision of a detent spring molded into the push button switch assembly cover for retaining a switch actuator in its activated position and for providing a relatively simple switch assembly.

Further and still other objects of the invention will become more clearly apparent when the following description is read in conjunction with the accompanying drawings.

BRIEF DESCRIPTION OF THE DRAWINGS

FIG. 1 is a perspective representation, partially in section, of a plurality of push button switch actuators comprising a switch assembly with one push button shaft removed;

FIG. 2 is a plan view of the assembly of FIG. 1 with the top plate and cover removed;

FIG. 3 is a sectional view taken along the line 3—3 of the assembly in FIG, 1;

FIG. 4 is a sectional view taken along line 4—4 of the assembly in FIG. 3, and FIG. 5 is a representation of the belt used in the invention.

DETAILED DESCRIPTION OF THE INVENTION

Referring now to the figures and to FIGS. 1 and 3 in particular, there is shown a push button switch assembly 10 comprising a plurality of push button switch actuators 12 in an apertured plate 14. Each push button switch actuator 12 of the assembly 10 includes oppositely disposed pairs of metal contacts 16 and a centrally disposed switch actuator shaft 18 having suitably located axially spaced detents 26 and 28 and a belt receiving groove 20 at the bottom of the shaft. The switch actuator 12, comprising movable contacts 16 and shaft 18, travels vertically as shown in FIG. 1 as the switch actuator moves from its first, upper, deactivated position to its second, lower, activated position.

Each switch actuator 12 is disposed within an aperture 21 in switch assembly cover 22. Molded into the cover 22 are a plurality of detent springs 24 for engaging each of the switch actuator shafts 18 at either the lower detent 26 when the switch actuator is in its deactivated position, as shown by the left-most switch actuator 12' in FIG. 3, or at the upper detent 28 when the switch actuator is in its activated position, as shown by the center switch actuator 12" in FIG. 3. The detents 26, 28 are suitably spaced apart axially along shaft 18 for causing the switch aactuator to be maintained in either its deactivated or activated position.

As best shown in FIG. 2, below cover 22 there is a corresponding base 30 having a plurality of stationary pairs of metal contacts 32 aligned to engage respective pairs of movable contacts 16 when a corresponding switch actuator 12 is activated.

The contacts 32 disposed in base 30 protrude from the bottom of the base and are soldered to corresponding receptacles in a printed circuit board 34 containing circuits which are opened or closed corresponding to the position of the associated switch actuator 12.

A flexible, unstretchable, electrically non-conductive belt 36 is anchored at both its ends by a pair of respective retaining devices 38, 40. The belt 36 is strung so as to be confined in the groove 20 of each shaft 18 and over tensioning risers 46 forming a part of base 30. Depending upon the switch assembly configuration, the belt 36 is wound around a turning post 42, such as the one shown in FIG. 2, and the length is selected for maintaining the belt in tension when a push button switch actuator is depressed as explained below. When the switch assembly comprises a linear array of push button switch actuators, the belt 36 is anchored at both ends by retaining devices 38, 40, as shown in FIG. 5, without passing around a turning post.

The length "a" of the belt 36 is selected so that when any one switch actuator 12 is placed in its activated position, there is sufficient flexibility in the belt to deform between tensioning risers 46 disposed in the base 30 at each side of the activated switch actuator as shown with reference to switch 12" actuator in FIG. 3. However, when another switch actuator 12 is subsequently urged into its respective activated position, the belt 36 will yield under the latter switch actuator between a pair of tensioning risers 46 while becoming taut elsewhere along its length thereby forcing a switch actuator already in its depressed, activated position to return to its deactivated position. The tension of the belt is such that a switch actuator maintained in the activated position by virtue of detent 28 and spring 24 will remain in that position until another switch actuator is activated.

It will be apparent that push button switch actuators 12 may be located in an almost unlimited variety of physical configurations such as linear, two dimensional matrix (as shown), circular, and the like, by use of a suitably selected belt and properly located turning posts and tensioning risers.

Having now described the elements of the push button switch assembly, construction of the assembly is achieved according to the following description. The base 30 having a plurality of sets of contacts 32 protruding from the bottom thereof, corresponding in location and quantity to the quantity and layout of switch actuators 12 in the assembly, is disposed in juxtaposition with a printed circuit board 34 having a corresponding pattern of receptacles for receiving the protruding contacts 32. The contacts 32 are soldered to the printed circuit board 34. The printed circuit board 34 contains circuitry for connecting desired circuits when the associated switch actuator 12 is activated. The belt 36 is then strung to be located with the sets of contacts 32 corresponding to the pattern of the pushbutton switch actuators 12 in the assembly 10 and around turning post 42. The ends of the belt 36 are fixedly attached to respective retaining devices 38, 40 in the base 30. Alternatively, the belt may be in the form of a continuous loop disposed around a plurality of turning posts. The length and tension placed on the belt are adjusted for permitting only one switch actuator to be in its activated position at any one time and for causing a previously activated switch actuator to be rendered deactivated upon actuation of a subsequent push button switch actuator 12. A cover 22 is placed over the base 30 and is held in place by conventional means such as screws or molded fasteners. The cover 22 includes aligned apertures 21 and molded detent springs for receiving respective switch actuators 12 as described below.

The respective switch actuator shafts 18 are inserted into the cover 22 such that the lower detent 26 of the shaft 18 engages a corresponding detent spring 24 in the cover 22. Concurrently, the belt 36 is confined in groove 20 of the shaft 18 and movable contacts 16 are aligned with the stationary contacts 32 in the base 30. A button cover 44 is pressed onto each shaft 18. The procedure is repeated for each push button switch actuator in the assembly. The plate 14 containing apertures 48 aligned with apertures 21 in the cover 22 is then secured over the assembly in a conventional manner.

Operation of the switch assembly will be best understood with reference to FIG. 4, where the solid lines represent a switch actuator 12 in its deactivated position and the dotted lines represent the same switch actuator 12 in its activated position.

As seen with reference to the left-most switch actuator 12' in FIG. 3 and the solid lines in FIG. 4, when the switch actuator is in its deactivated position, the lower shaft detent 26 engages detent spring 24 and belt 36 does not flex between a corresponding pair of tensioning risers 46 located adjacent to each side of the deactivated switch actuator 12'. When a respective switch actuator 12' is urged from its deactivated position to its activated position, as shown in the center switch actuator 12" in FIG. 3 and the dashed lines in FIG. 4, the movable contacts 16 engage corresponding stationary contacts 32 in the base 30 thereby closing a circuit and allowing current to be switched. The portion of the belt 36 disposed within the groove 20 of shaft 18 of the activated switch actuator 12" is urged downward causing, by virtue of tensioning risers 46 adjacent to each side of the switch actuator 12", the tension in the remainder of the belt to raise a previously lowered switch actuator. Also, the upper detent 28 of the actuated switch actuator engages detent spring 24 to maintain the switch actuator 12" in its activated position while the belt 36 remains flexed under the shaft 18 between adjacent tensioning risers until another switch actuator in the assembly is activated. The cycle of events is repeated each time a switch actuator 12 is activated for causing, at any one time, only the selected switch actuator 12 of the assembly 10 to be in its activated position.

It will be apparent to those skilled in the art that the present invention simplifies the heretofore used switch assembly construction by obviating the requirement for complex spring and latch mechanisms comprising electrically conductive material. In a preferred embodiment, the belt is made of a non-conductive material, such as Kevlar fibers. The plate 14, shaft 18, switch assembly cover 22, base 30, printed circuit board 34, and botton 44 are all made of electrically non-conductive materials. Therefore, only the current carrying contacts 16 and 32 are metallic and conductive. The remainder of the switch assembly is non-conductive and does not interfere with the circuit operation.

While there has been described and illustrated a preferred embodiment of a push button switch assembly, it will be apparent to those skilled in the art that modifications and variations can be made without deviating from the broad scope of the invention which shall be limited solely to the claims appended hereto.

What is claimed is:

1. A push button switch assembly comprising:

a base having a plurality of stationary contact means thereon and including belt support means;

a belt disposed on said base following a predetermined path determined by said belt support means;

a cover including a plurality of engagement means, said engagement means being disposed opposite and inwardly of said stationary contact means and said cover being coupled to said base, and a plurality of switch actuator means each including moveable contact means disposed for engaging a respective one of said stationary contact means when a respective one of said switch actuator means is activated and each switch actuator means having means for engaging said engagement means at a first position when said switch actuator means is deactivated and at a second position when said switch actuator means is activated and being coupled to said belt whereby when a first switch actuator means is activated to engage said engagement means at its second position, a previously activated switch actuator means is urged by said belt to engage said engagement means at its first position.

2. A push button switch assembly as set forth in claim 1, including a printed circuit board having a plurality of contact receiving means coupled to said plurality of stationary contact means.

3. A push button switch assembly as set forth in claims 1 or 2, and further including an apertured plate means retaining said switch actuator means in predetermined spatial relation to said cover.

4. A push button switch assembly as set forth in claims 1 or 2, said belt being made of a material which is flexible, unstretchable and electrically non-conductive.

5. A push button switch assembly as set forth in claims 1 or 2, said switch actuator means being coupled to said belt by means of a groove disposed in said switch actuator means for confining said belt.

6. A push button switch assembly as set forth in claims 1 or 2, said engagement means comprising a detent spring molded in said cover, said switch actuator means including a shaft, and said means for engaging said engagement means comprising detents axially spaced along said shaft.

7. A push button switch assembly as set forth in claim 6, said shaft including a groove therein for confining said belt.

8. A push botton switch assembly as set forth in claims 1 or 2, said belt support means including tensioning risers disposed adjacent to both sides of said switch actuator means.

9. A push button switch assembly as set forth in claims 1 or 2, said belt being in the form of a continuous loop and said belt support means including turning posts.

10. A push button switch assembly comprising:

a printed circuit board having a plurality of contact receiving means;

a base having a plurality of stationary contact means protruding therefrom, said stationary contact means being coupled to said contact receiving means, and said base including belt support means;

a belt disposed on said base in proximity to said stationary contact means and coupled to said belt support means;

a cover including a plurality of detent springs forming a part of said cover disposed opposite and inwardly of said plurality of stationary contact means, said cover being coupled to said base;

a plurality of switch actuator means each including moveable contact means for engaging a respective one of said stationary contact means in said base when said corresponding switch actuator means is activated and each switch actuator means further including shaft means having a groove for confining said belt therein and having an upper detent position and a lower detent position disposed for engaging a respective said detent spring at said lower detent position when said respective switch actuator means is deactivated and engaging said detent spring at said upper detent position when said respective switch actuator means is activated whereby when a respective switch actuator means is activated and said upper detent position engages said detent spring, said shaft exerts a force against said belt for causing a heretofore engaged moveable contact to become disengaged, leaving only said moveable contact means of the activated switch actuator means engaged to a respective one of said stationary contact means in said base, and an apertured plate means retaining said switch actuator means in predetermined spatial relation to said cover.

11. A push button switch assembly as set forth in claim 10, said belt being made of a material which is flexible, unstretchable and electrically non-conductive.

* * * * *